US008901821B2

(12) United States Patent
Jung et al.

(10) Patent No.: US 8,901,821 B2
(45) Date of Patent: Dec. 2, 2014

(54) APPARATUS FOR DRIVING FLUORESCENT LAMP

(75) Inventors: Kuang-Yu Jung, Taipei (TW); Shih-Chung Huang, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 401 days.

(21) Appl. No.: 13/483,003

(22) Filed: May 29, 2012

(65) Prior Publication Data

US 2013/0015769 A1 Jan. 17, 2013

(30) Foreign Application Priority Data

Jul. 11, 2011 (TW) ..... 100124438 A

(51) Int. Cl.
*H05B 41/36* (2006.01)

(52) U.S. Cl.
CPC ..... *H05B 41/36* (2013.01)
USPC ..... 315/127; 315/224

(58) Field of Classification Search
CPC .. G02B 19/0014; G02B 19/009; G02B 26/10; G02B 19/0085; G02B 27/095; G02B 19/0052; G02B 19/0095; G02B 19/0028; G02B 19/0057; G02B 19/0066; G02B 26/105; G02B 27/0961; G02B 27/0966
See application file for complete search history.

(56) References Cited

U.S. PATENT DOCUMENTS

| | | | | |
|---|---|---|---|---|
| 7,952,256 | B2 | 5/2011 | Matsumoto et al. | |
| 7,965,047 | B2 | 6/2011 | Wang | |
| 2005/0067972 | A1 * | 3/2005 | Lee et al. | 315/200 R |
| 2007/0159107 | A1 * | 7/2007 | Powell | 315/149 |
| 2009/0267669 | A1 * | 10/2009 | Kasai | 327/164 |

FOREIGN PATENT DOCUMENTS

| | | |
|---|---|---|
| TW | I270839 | 1/2007 |
| TW | 200948200 | 11/2009 |

OTHER PUBLICATIONS

"Office Action of Taiwan Counterpart Application", issued on Jun. 10, 2014, p. 1-p. 3.

* cited by examiner

*Primary Examiner* — Crystal L Hammond
(74) *Attorney, Agent, or Firm* — Winston Hsu; Scott Margo

(57) ABSTRACT

An apparatus for driving a fluorescent lamp is provided. The provided apparatus includes a power switching circuit, an LC resonator and an automatic frequency tracing circuit. The power switching circuit is coupled between an input voltage and a ground potential, and configured for switching and outputting the input voltage and the ground potential in response to two output signals with a phase difference of 180 degrees so as to generate a square signal. The LC resonator is configured for receiving and converting the square signal, so as to generate a sinusoidal driving signal for driving the fluorescent lamp. The automatic frequency tracing circuit is configured for generating and adjusting the two output signals according to a current feedback signal relating to the sinusoidal driving signal, so as to make the frequency of the sinusoidal driving signal automatically follow the resonant frequency of the LC resonator.

25 Claims, 7 Drawing Sheets

APPARATUS FOR DRIVING FLUORESCENT LAMP

CROSS-REFERENCE TO RELATED APPLICATION

This application claims the priority benefit of Taiwan application serial no. 100124438, filed on Jul. 11, 2011. The entirety of the above-mentioned patent application is hereby incorporated by reference herein and made a part of this specification.

BACKGROUND OF THE INVENTION

1. Field of the Invention

The invention relates to a driving technique of a fluorescent lamp, more particularly, to an apparatus for driving a fluorescent lamp without using a boost transformer.

2. Description of the Related Art

Fluorescent lamps (for example, cold cathode fluorescent lamps (CCFLs)) are widely applied to the backlight systems in monitors and televisions of large-scale liquid crystal displays (LCDs). As shown in FIG. 1, an apparatus 10 used for driving a CCFL CL generally includes a power switching circuit 101, a boost transformer T, and a resonator formed by a leakage inductance of the boost transformer T and two capacitors C.

Generally, the power switching circuit 101 is coupled between an input voltage VDD (which is a direct current (DC) voltage of about 380V) and a ground potential GND, and is used for switching and outputting the input voltage VDD and the ground potential GND in response to a ramp signal RMP with fixed frequency and a comparison voltage CMP, so as to generate a square signal SQ. Moreover, the resonator formed by the leakage inductance of the boost transformer T and the two capacitors C filters/converts the square signal SQ generated by the power switching circuit 101 to generate a sinusoidal driving signal SIN (which has a root mean square (RMS) value of about 342V) for driving the CCFL CL.

However, since the CCFL CL requires a relative high operation voltage with an RMS value of about 700V, the boost transformer T has to be used to boost the sinusoidal driving signal SIN to a voltage range capable of operating the CCFL CL. Therefore, the apparatus 10 used for driving the CCFL CL has to use the boost transformer T, or otherwise the CCFL CL cannot be successfully driven.

SUMMARY OF THE INVENTION

Accordingly, the invention is directed to an apparatus for driving a fluorescent lamp without using a boost transformer.

The invention provides an apparatus for driving a fluorescent lamp, which includes a power switching circuit, an LC resonator and an automatic frequency tracing circuit. The power switching circuit is coupled between an input voltage and a ground potential, and is configured for switching and outputting the input voltage and the ground potential in response to two output signals with a phase difference of 180 degrees, so as to generate a square signal. The LC resonator is coupled to the power switching circuit, and is configured for receiving and converting the square signal, so as to generate a sinusoidal driving signal for driving the fluorescent lamp. The automatic frequency tracing circuit is coupled to the power switching circuit and the LC resonator, and is configured for generating and adjusting the two output signals according to a current feedback signal relating to the sinusoidal driving signal, so as to make a frequency of the sinusoidal driving signal automatically follow a resonant frequency of the LC resonator.

An embodiment of the invention, the power switching circuit includes a high-side buffer, a low-side buffer and a switching circuit. The high-side buffer is configured for receiving and buffering-outputting a first output signal of the two output signals. The low-side buffer is configured for receiving and buffering-outputting a second output signal of two output signals. The switching circuit is coupled between the input voltage and the ground potential and is coupled to the high-side buffer and the low-side buffer. The switching circuit is configured for switching and outputting the input voltage and the ground potential in response to the buffered-outputted first and second output signals, so as to generate the square signal.

An embodiment of the invention, the LC resonator includes a first to a third capacitors and an inductor. A first terminal of the first capacitor is configured for receiving the square signal. A first terminal of the inductor is coupled to a second terminal of the first capacitor, and a second terminal of the inductor is configured for generating the sinusoidal driving signal. A first terminal of the second capacitor is coupled to the second terminal of the inductor. A first terminal of the third capacitor is coupled to a second terminal of the second capacitor, and a second terminal of the third capacitor is configured for generating the current feedback signal.

An embodiment of the invention, the automatic frequency tracing circuit includes a phase signal generator, a pulse signal generator, a pulse width modulation (PWM) signal generating unit, a phase-splitting circuit and a ramp generator. The phase signal generator is configured for outputting a phase signal in response to the current feedback signal. The pulse signal generator is coupled to the phase signal generator, and is configured for generating a pulse signal in response to the phase signal. The PWM signal generating unit is coupled to the pulse signal generator, and is configured for generating a PWM signal in response to a ramp signal, a comparison voltage and the pulse signal. The phase-splitting circuit is coupled to the PWM signal generating unit, and is configured for receiving the PWM signal and performing phase-splitting to the PWM signal in response to the phase signal, so as to obtain the two output signals. The ramp generator is coupled to the PWM signal generating unit and the phase-splitting circuit, and is configured for generating the ramp signal in response to the two output signals.

An embodiment of the invention, the automatic frequency tracing circuit further includes a starting of oscillation circuit coupled to the phase signal generator, the pulse signal generator and the phase-splitting circuit. The starting of oscillation circuit is configured for transmitting, when the phase signal is oscillated, the phase signal to the pulse signal generator in response to an enabling signal, so as to make the pulse signal generator generate the pulse signal. In addition, the starting of oscillation circuit is further configured for providing, when the phase signal is not oscillated, an oscillation signal to the pulse signal generator in response to the enabling signal, so as to make the pulse signal generator generate the pulse signal until the phase signal is oscillated.

An embodiment of the invention, the automatic frequency tracing circuit further includes a phase signal detector coupled to the phase signal generator and the starting of oscillation circuit. The phase signal detector is configured for receiving and detecting whether the phase signal is oscillated or not, and generating the enabling signal to the starting of oscillation circuit accordingly.

An embodiment of the invention, the automatic frequency tracing circuit further includes a current regulation circuit coupled to the fluorescent lamp and the PWM signal generating unit. The current regulation circuit is configured for generating the comparison voltage in response to a current flowing through the fluorescent lamp and a first predetermined reference voltage, so as to adjust the PWM signal outputted by the PWM signal generating unit, and stabilize the current flowing through the fluorescent lamp to a predetermined current value.

An embodiment of the invention, the automatic frequency tracing circuit further includes a clamp circuit coupled to the LC resonator and the current regulation circuit. The claim circuit is configured for adjusting the comparison voltage according to a voltage feedback signal relating to the sinusoidal driving signal and a second predetermined reference voltage, so as to suppress a voltage of the sinusoidal driving signal to a predetermined reference value.

An embodiment of the invention, the automatic frequency tracing circuit further includes a protection circuit coupled to the phase-splitting circuit and the current regulation circuit. The protection circuit is configured for generating a disabling signal to disable the phase-splitting circuit in response to an open-circuit or a short-circuit of the fluorescent lamp.

From the above, in the invention, the automatic frequency tracing circuit is used/configured to trace the resonant frequency of the LC resonator, so that regardless of how the resonant frequency of the LC resonator varies, the automatic frequency tracing circuit makes the frequency of the sinusoidal driving signal that is generated by the LC resonator and used for driving the fluorescent lamp to automatically follow the resonant frequency of the LC resonator. In this way, as long as a quality factor (Q value) of the LC resonator is designed relatively higher, a relatively large output to input ratio is obtained, so that the fluorescent lamp can be successfully driven without using a boost transformer.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
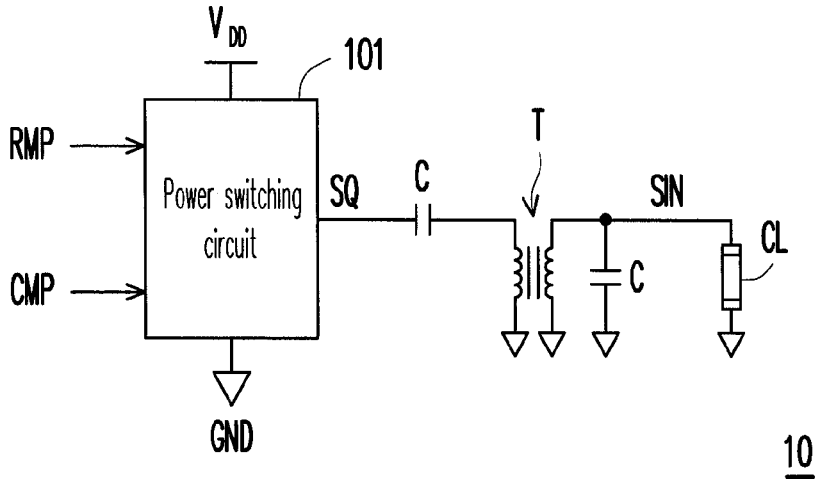
FIG. 1 (RELATED ART)
FIG. 1 is a schematic diagram of a conventional driving apparatus 10 of a fluorescent lamp CL.

Reference will now be made in detail to the present preferred embodiments of the invention, examples of which are illustrated in the accompanying drawings. Wherever possible, the same reference numbers are used in the drawings and the description to refer to the same or like parts.

Figure 2:
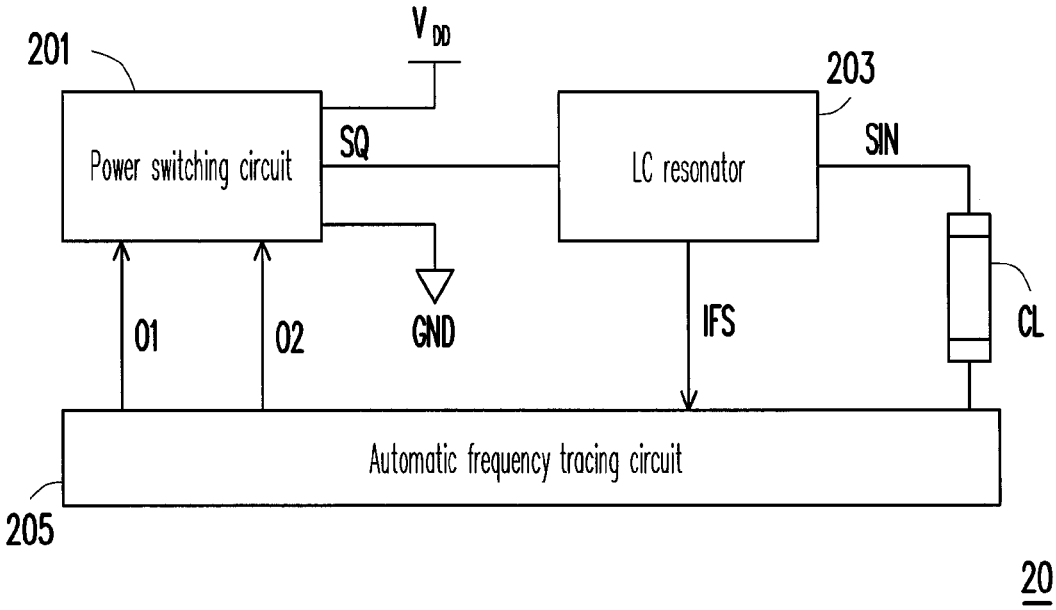
FIG. 2 is a schematic diagram of a driving apparatus 20 of a fluorescent lamp CL according to an embodiment of the invention.
Figure 3:
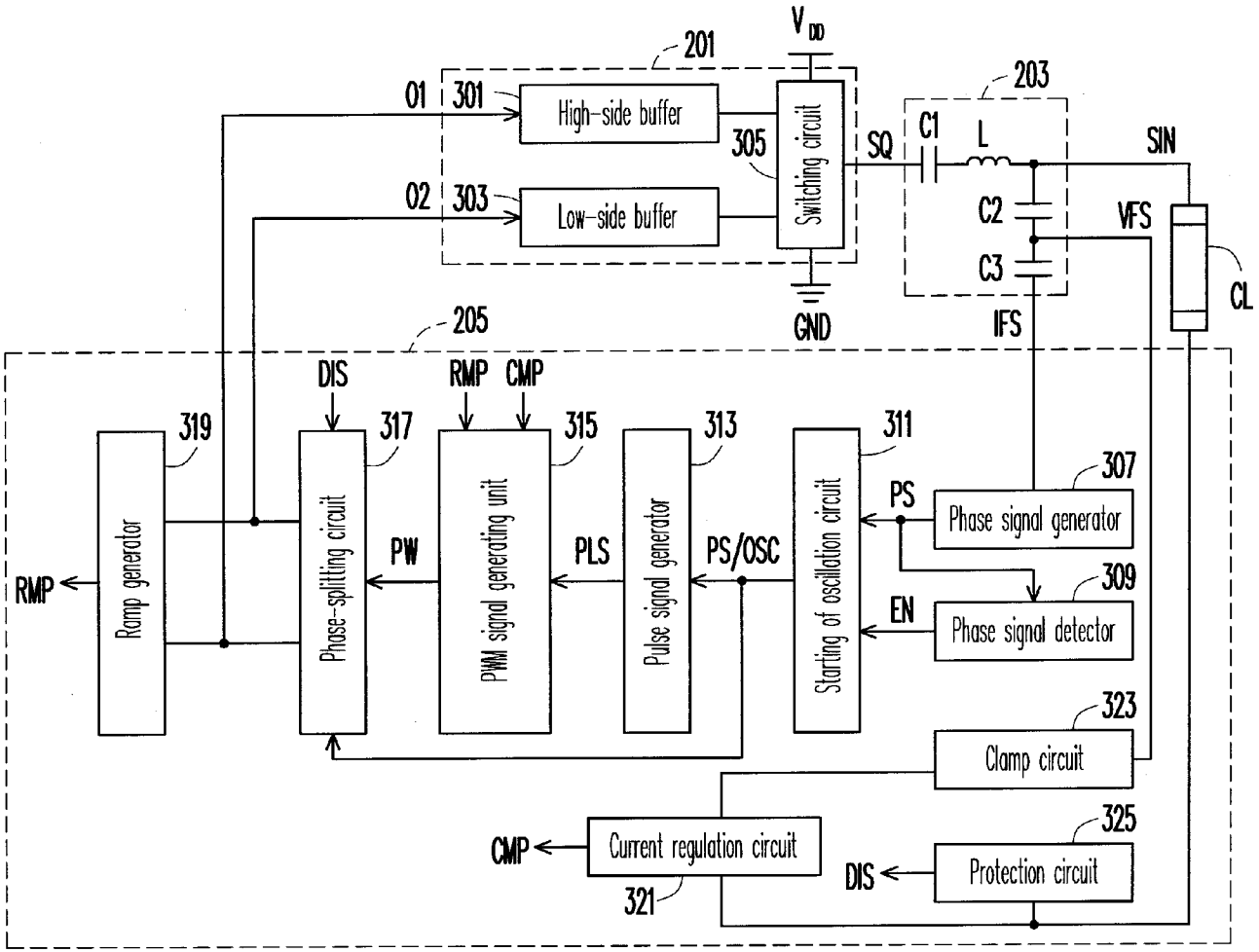
FIG. 3 is a circuit schematic diagram of the driving apparatus 20 of FIG. 2.

FIG. 2 is a schematic diagram of a driving apparatus 20 of a fluorescent lamp CL according to an embodiment of the invention, and FIG. 3 is a circuit schematic diagram of the driving apparatus 20. Referring to FIG. 2 and FIG. 3, the driving apparatus 20 of the present embodiment is at least adapted to drive a cold cathode fluorescent lamp (CCFL, though the invention is not limited thereto, and other types of the fluorescent lamp can also be applied), and the driving apparatus 20 includes a power switching circuit 201, an LC resonator 203 and an automatic frequency tracing circuit 205. The power switching circuit 201 is coupled between an input voltage $V_{DD}$ (which is a direct current (DC) voltage of about 380V) and a ground potential GND, and is used/configured for switching and outputting the input voltage $V_{DD}$ and the ground potential GND in response to two output signals with a phase difference of 180 degrees (for example, a first output signal 01 and a second output signal 02) which are generated by the automatic frequency tracing circuit 205, so as to generate a square signal SQ.

In this embodiment, the power switching circuit 201 may include a high-side buffer 301, a low-side buffer 303 and a switching circuit 305. The high-side buffer 301 is configured for receiving and buffering-outputting the first output signal 01. The low-side buffer 303 is configured for receiving and buffering-outputting the second output signal 02. The switching circuit 305 is coupled between the input voltage $V_{DD}$ and the ground potential GND, and is coupled to the high-side buffer 301 and the low-side buffer 303. The switching circuit 305 is configured for switching and outputting the input voltage $V_{DD}$ and the ground potential GND in response to the buffered-outputted first and second output signals 01' and 02', so as to generate the square signal SQ.

Figure 4:
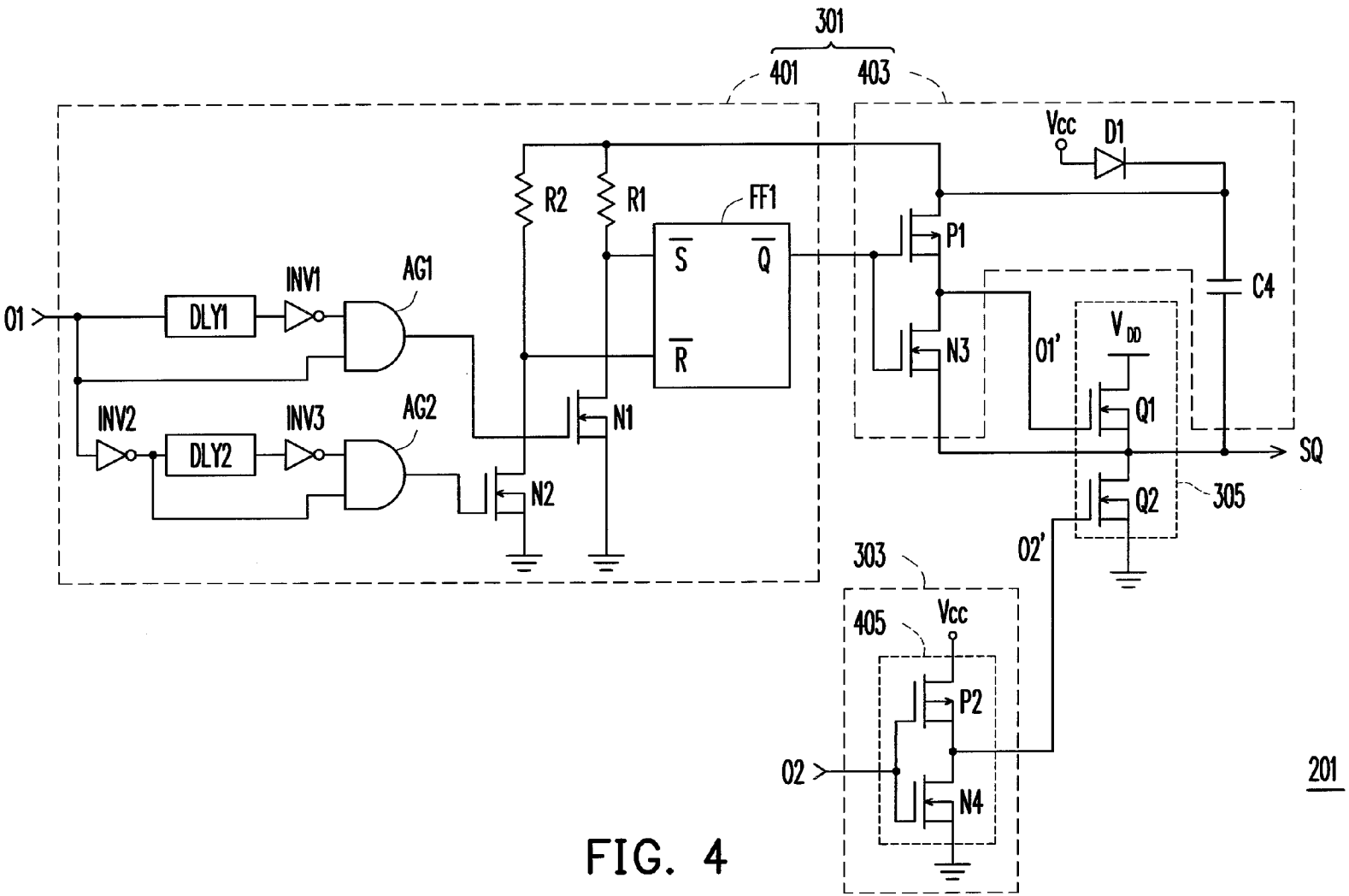
FIG. 4 is a circuit schematic diagram of a power switching circuit 201 according to an embodiment of the invention.

To be specific, FIG. 4 is a circuit schematic diagram of the power switching circuit 201 according to an embodiment of the invention. Referring to FIGS. 3 and 4, the switching circuit 305 includes N-type power transistors Q1 and Q2. A drain of the N-type power transistor Q1 is coupled to the input voltage $V_{DD}$, a source of the N-type power transistor Q1 is configured for generating the square signal SQ, and a gate of the N-type power transistor Q1 is configured for receiving the buffered-outputted first output signal 01'. A source of the N-type power transistor Q2 is coupled to the ground potential GND, a drain of the N-type power transistor Q2 is coupled to the source of the N-type power transistor Q1, and a gate of the N-type power transistor Q2 is configured for receiving the buffered-outputted second output signal 02'.

In addition, the high-side buffer 301 includes a level shifter 401 and a high-side driver 403. The level shifter 401 is configured for receiving the first output signal 01, and pulling up a level of the first output signal 01 in response to a rising edge and a falling edge of the first output signal 01. The high-side driver 403 is coupled to the level shifter 401, and is configured for generating the buffered-outputted first output signal 01' in response to an output of the level shifter 401.

To be specific, the level shifter 401 includes delay cells DLY1 and DLY2, inverters INV1 to INV3, AND gates AG1 and AG2, N-type transistors N1 and N2, resistors R1 and R2, and an $\overline{SR}$ flip-flop FF1. The delay cell DLY1 is configured for receiving and delaying-outputting the first output signal 01. An input terminal of the inverter INV1 is coupled to an output of the delay cell DLY1. A first input terminal of the AND gate AG1 is coupled to an output of the inverter INV1, and a second input terminal of the AND gate AG1 is coupled to an input of the delay cell DLY1.

An input terminal of the inverter INV2 is coupled to the input of the delay cell DLY1. The delay cell DLY2 is configured for receiving and delaying-outputting an output of the inverter INV2. An input terminal of the inverter INV3 is coupled to an output of the delay cell DLY2. A first input terminal of the AND gate AG2 is coupled to an output of the inverter INV3, and a second input terminal of the AND gate AG2 is coupled to an input of the delay cell DLY2. A gate of the N-type transistor N1 is coupled to an output of the AND gate AG1, and a source of the N-type transistor N1 is coupled to the ground potential GND.

A gate of the N-type transistor N2 is coupled to an output of the AND gate AG2, and a source of the N-type transistor N2 is coupled to the ground potential GND. A first terminal of the resistor R1 is coupled to a drain of the N-type transistor N1. A first terminal of the resistor R2 is coupled to a drain of the N-type transistor N2, and a second terminal of the resistor R2 is coupled to a second terminal of the resistor R1. A set terminal $\overline{S}$ of the $\overline{SR}$ flip-flop FF1 is coupled to the first terminal of the resistor R1, a reset terminal $\overline{R}$ of the $\overline{SR}$ flip-flop FF1 is coupled to the first terminal of the resistor R2, and an output terminal $\overline{Q}$ of the $\overline{SR}$ flip-flop FF1 is configured for outputting the pulled up first output signal.

In addition, the high-side driver 403 includes a P-type transistor P1, an N-type transistor N3, a diode D1 and a capacitor C4. A gate of the P-type transistor P1 is coupled to the output terminal $\overline{Q}$ of the $\overline{SR}$ flip-flop FF1, a source of the P-type transistor P1 is coupled to the second terminals of the resistors R1 and R2, and a drain of the P-type transistor P1 is coupled to the gate of the N-type power transistor Q1 for generating the buffered-outputted first output signal 01'. A gate of the N-type transistor N3 is coupled to the gate of the P-type transistor P1, a drain of the N-type transistor N3 is coupled to the drain of the P-type transistor P1, and a source of the N-type transistor N3 is coupled to the source of the N-type power transistor Q1. An anode of the diode D1 is configured for receiving a system voltage Vcc, and a cathode of the diode D1 is coupled to the source of the P-type transistor P1. A first terminal of the capacitor C4 is coupled to the cathode of the diode D1, and a second terminal of the capacitor C4 is coupled to the source of the N-type power transistor Q1. In this embodiment, the diode D1 and the capacitor C4 form a boost circuit for pulling up the level of the buffered-outputted first output signal 01', so as to make sure that the buffered-outputted first output signal 01' can successfully turn-on the N-type power transistor Q1.

Relatively, the low-side buffer 303 includes a low-side driver 405. The low-side driver 405 is configured for generating the buffered-outputted second output signal 02' in response to the second output signal 02. To be specific, the low-side driver 405 includes a P-type transistor P2 and an N-type transistor N4. A gate of the P-type transistor P2 is configured for receiving the second output signal 02, a source of the P-type transistor P2 is configured for receiving the system voltage Vcc, and a drain of the P-type transistor P2 is coupled to the gate of the N-type power transistor Q2 for generating the buffered-outputted second output signal 02'. A gate of the N-type transistor N4 is coupled to the gate of the P-type transistor P2, a drain of the N-type transistor N4 is coupled to the drain of the P-type transistor P2, and a source of the N-type transistor N4 is coupled to the ground potential GND.

Herein, please refer back to FIG. 3, the LC resonator 203 is coupled to the power switching circuit 201, and is configured for receiving and converting the square signal SQ generated by the power switching circuit 201, so as to generate a sinusoidal driving signal SIN for driving the fluorescent lamp CL. To be specific, the LC resonator 203 includes capacitors C1 to C3 and an inductor L. A first terminal of the capacitor C1 is configured for receiving the square signal SQ. A first terminal of the inductor L is coupled to a second terminal of the capacitor C1, and a second terminal of the inductor L is configured for generating the sinusoidal driving signal SIN. A first terminal of the capacitor C2 is coupled to the second terminal of the inductor L. A first terminal of the capacitor C3 is coupled to a second terminal of the capacitor C2, and a second terminal of the capacitor C3 is configured for generating a current feedback signal IFS relating to the sinusoidal driving signal SIN generated by the LC resonator 203.

Moreover, in this embodiment, the automatic frequency tracing circuit 205 is coupled to the power switching circuit 201 and the LC resonator 205, and is configured for generating and adjusting the output signals 01 and 02 according to the current feedback signal IFS relating to the sinusoidal driving signal SIN generated by the LC resonator 203, so as to make a frequency of the sinusoidal driving signal SIN generated by the LC resonator 203 automatically follow a resonant frequency of the LC resonator 203.

Figure 5:
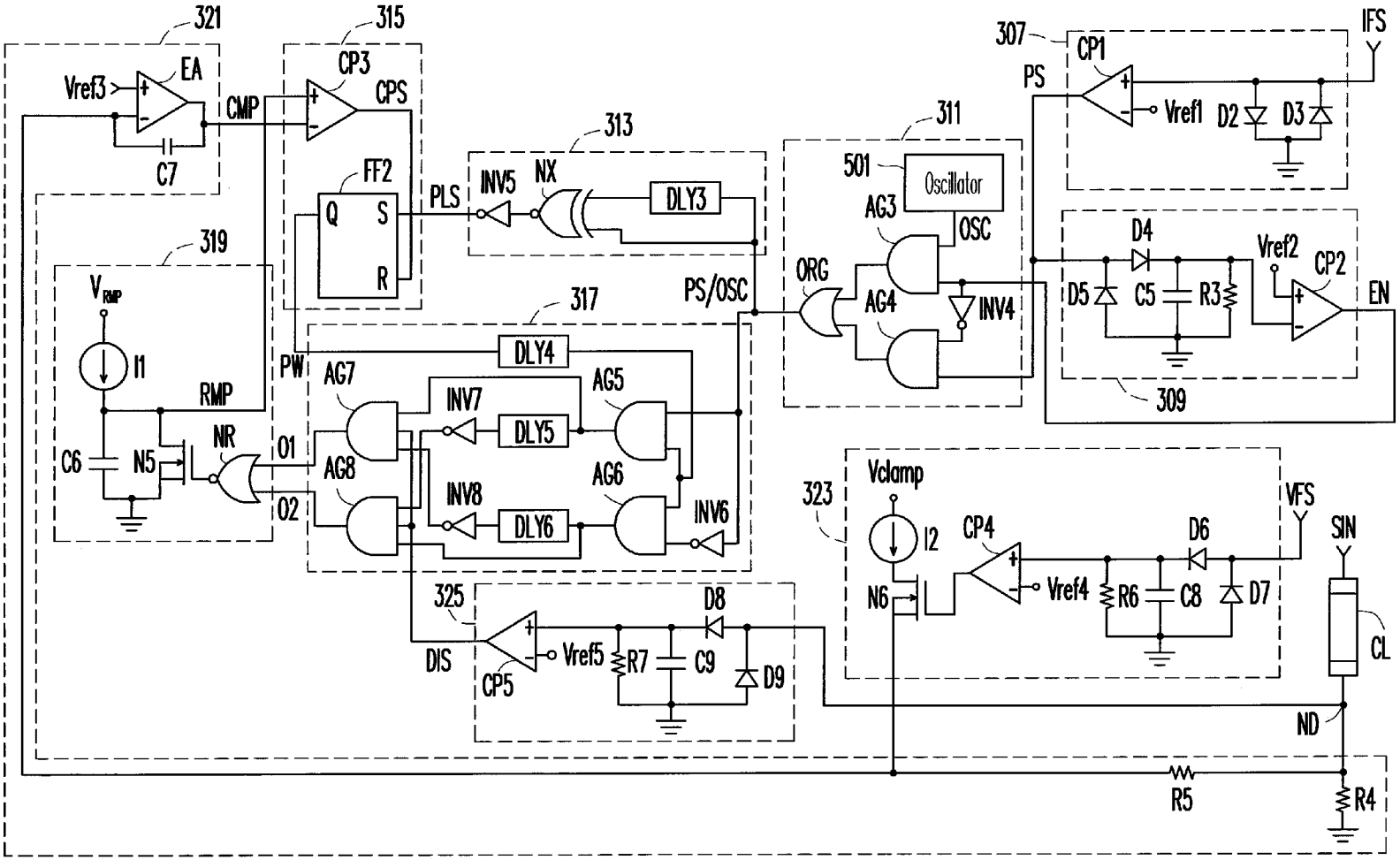
FIG. 5 is a circuit schematic diagram of an automatic frequency tracing circuit 205 according to an embodiment of the invention.

To be specific, FIG. 5 is a circuit schematic diagram of the automatic frequency tracing circuit 205 according to an embodiment of the invention. Referring to FIGS. 3 and 5, the automatic frequency tracing circuit 205 includes a phase signal generator 307, a phase signal detector 309, a starting of oscillation circuit 311, a pulse signal generator 313, a pulse width modulation (PWM) signal generating unit 315, a phase-splitting circuit 317, a ramp generator 319, a current regulation circuit 321, a clamp circuit 323 and a protection circuit 325.

In this embodiment, the phase signal generator 307 is configured for outputting a phase signal PS in response to the current feedback signal IFS of the LC resonator 203. To be specific, the phase signal generator 307 includes a comparator CP1 and diodes D2 and D3. a positive input terminal (+) of the comparator CP1 is configured for receiving the current feedback signal IFS, a negative input terminal (−) of the comparator CP1 is configured for receiving a predetermined reference voltage Vref1, and an output terminal of the comparator CP1 is configured for outputting the phase signal PS. An anode of the diode D2 is coupled to the positive input terminal (+) of the comparator CP1, and a cathode of the diode D2 is coupled to the ground potential GND. A cathode of the diode D3 is coupled to the positive input terminal (+) of the comparator CP1, and an anode of the diode D3 is coupled to the ground potential GND.

In addition, the phase signal detector 309 is coupled to the phase signal generator 307 and the starting of oscillation circuit 311, and is configured for receiving and detecting whether the phase signal PS generated by the phase signal generator 307 is oscillated or not, and generating an enabling signal EN to the starting of oscillation circuit 311 accordingly. To be specific, the phase signal detector 309 includes diodes D4 and D5, a capacitor C5, a resistor R3 and a comparator CP2. An anode of the diode D4 is configured for receiving the phase signal PS generated by the phase signal generator 307. An anode of the diode D5 is coupled to the ground potential GND, and a cathode of the diode D5 is coupled to the anode of the diode D4. A first terminal of the capacitor C5 is coupled to a cathode of the diode D4, and a second terminal of the capacitor C5 is coupled to the ground potential GND.

The resistor R3 is coupled with the capacitor C5 in parallel. A positive input terminal (+) of the comparator CP2 is configured for receiving a predetermined reference voltage Vref2, a negative input terminal (−) of the comparator CP2 is coupled to the cathode of the diode D4, and an output terminal of the comparator CP2 is configured for outputting the enabling signal EN. In this embodiment, when the phase signal detector 309 detects that the phase signal PS generated by the phase signal generator 307 is oscillated, the phase signal detector 309 would output the enabling signal EN with a logic low level (i.e. logic "0") to the starting of oscillation circuit 311; otherwise, when the phase signal detector 309 detects that the phase signal PS generated by the phase signal generator 307 is not oscillated, the phase signal detector 309 would output the enabling signal EN with a logic high level (i.e. logic "1") to the starting of oscillation circuit 311.

Moreover, the starting of oscillation circuit 311 is coupled to the phase signal generator 307, the phase signal detector 309, the pulse signal generator 313 and the phase-splitting circuit 317. In this embodiment, the starting of oscillation circuit 311 is configured for transmitting, when the phase signal PS generated by the phase signal generator 307 is oscillated, the phase signal PS to the pulse signal generator 313 in response to the enabling signal EN with the logic low level (i.e. logic "0") generated by the phase signal detector 309, so as to make the pulse signal generator 313 generate the pulse signal PLS. In addition, the starting of oscillation circuit 311 is further configured for providing, when the phase signal PS generated by the phase signal generator 307 is not oscillated, an oscillation signal OSC to the pulse signal generator 313 in response to the enabling signal EN with the logic high level (i.e. logic "1") generated by the phase signal detector 309, so as to make the pulse signal generator 313 generate the pulse signal PLS until the phase signal PS generated by the phase signal generator 307 is oscillated.

To be specific, the starting of oscillation circuit 311 includes an oscillator 501, AND gates AG3 and AG4, an inverter INV4 and an OR gate ORG. The oscillator 501 is configured for generating the oscillation signal OSC which is similar to the oscillated phase signal PS. A first input terminal of the AND gate AG3 is configured for receiving the oscillation signal OSC, and a second input terminal of the AND gate AG3 and an input terminal of the inverter INV4 are configured for receiving the enabling signal EN generated from the phase signal detector 309. A first input terminal of the AND gate AG4 is configured for receiving the phase signal PS generated from the phase signal generator 307, and a second input terminal of the AND gate AG4 is coupled to an output of the inverter INV4. A first input terminal of the OR gate ORG is a coupled to an output of the AND gate AG3, a second input terminal of the OR gate ORG is coupled to an output of the AND gate AG4, and an output terminal of the OR gate ORG is configured for outputting, in response to the enabling signal EN, the phase signal PS or the oscillation signal OSC.

In this embodiment, when the phase signal PS generated by the phase signal generator 307 is not oscillated, it is represents that the square signal SQ is not provided by the power switching circuit 201 to the LC resonator 203 at this time. Accordingly, the LC resonator 203 would not generate the sinusoidal driving signal SIN to drive the fluorescent lamp CL. Otherwise, when the phase signal PS generated by the phase signal generator 307 is oscillated, it is represents that the square signal SQ has provided by the power switching circuit 201 to the LC resonator 203 at this time. Accordingly, the LC resonator 203 would generate the sinusoidal driving signal SIN to drive the fluorescent lamp CL.

In this case, when the phase signal PS generated by the phase signal generator 307 is oscillated, the phase signal detector 309 would accordingly generate the enabling signal EN with the logic low level (i.e. logic "0") to the starting of oscillation circuit 311, and thus making the starting of oscillation circuit 311 transmit the phase signal PS. Otherwise, when the phase signal PS generated by the phase signal generator 307 is not oscillated, the phase signal detector 309 would accordingly generate the enabling signal EN with the logic high level (i.e. logic "1") to the starting of oscillation circuit 311, and thus making the starting of oscillation circuit 311 transmit the oscillation signal OSC until the phase signal PS generated by the phase signal generator 307 is oscillated. It is noted that if the stop-oscillation of the phase signal PS generated by the phase signal generator 307 is never happened, the phase signal detector 309 and the starting of oscillation circuit 311 can be omitted. However, in actual, the configuration of the phase signal detector 309 and the starting of oscillation circuit 311 can promote the reliability of the whole driving apparatus 20.

Accordingly, the pulse signal generator 313 would generate the pulse signal PLS in response to the phase signal PS or the oscillation signal OSC. To be specific, the pulse signal generator 313 includes a delay cell DLY3, an NXOR gate NX and an inverter INV5. The delay cell DLY3 is configured for receiving and delaying-outputting the phase signal PS or the oscillation signal OSC. A first input terminal of the NXOR gate NX is configured for receiving the phase signal PS or the oscillation signal OSC, and a second input terminal of the NXOR gate NX is configured for receiving an output of the delay cell DLY3. An input terminal of the inverter INV5 is coupled to an output of the NXOR gate NX, and an output terminal of the inverter INV5 is configured for outputting the pulse signal PLS.

In addition, the PWM signal generating unit 315 is coupled to the pulse signal generator 313, and is configured for generating a PWM signal PW in response to a ramp signal RMP from the ramp generator 319, a comparison voltage CMP from the current regulation circuit 321 and the pulse signal PLS from the pulse signal generator 313. To be specific, the PWM signal generating unit 315 includes a comparator CP3 and an SR flip-flop FF2. A positive input terminal (+) of the comparator CP3 is configured for receiving the ramp signal RMP, a negative input terminal (−) of the comparator CP3 is configured for receiving the comparison voltage CMP, and an output terminal of the comparator CP3 is configured for outputting a comparison signal CPS. a set terminal S of the SR flip-flop FF2 is configured for receiving the pulse signal PLS, a reset terminal R of the SR flip-flop FF2 is configured for receiving the comparison signal CPS, and an output terminal of the SR flip-flop FF2 is configured for outputting the PWM signal PW.

Moreover, the phase-splitting circuit 317 is coupled to the PWM signal generating unit 315, and is configured for receiving the PWM signal PW, and performing phase-splitting to the PWM signal PW in response to the phase signal PS or the oscillation signal OSC, so as to obtain the first and the second output signals 01 and 02. To be specific, the phase-splitting circuit 317 includes delay cells DLY4 to DLY6, AND gates AG5 to AG8 and inverters INV6 to INV8. The delay cell DLY4 is configured for receiving and delaying-outputting the PWM signal PW. A first input terminal of the AND gate AG5 is configured for receiving the phase signal PS or the oscillation signal OSC, and a second input terminal of the AND gate AG5 is coupled to an output of the delay cell DLY4.

An input terminal of the inverter INV6 is configured for receiving the phase signal PS or the oscillation signal OSC. A first input terminal of the AND gate AG6 is coupled to an output of the inverter INV6, and a second input terminal of the AND gate AG6 is coupled to the output of the delay cell DLY4. The delay cell DLY5 is configured for receiving and delaying-outputting an output of the AND gate AG5. The delay cell DLY6 is configured for receiving and delaying-outputting an output of the AND gate AG6. An input terminal of the inverter INV7 is coupled to an output of the delay cell DLY5. An input terminal of the inverter INV8 is coupled to an output of the delay cell DLY6. A first input terminal of the AND gate AG7 is coupled to an input of the delay cell DLY5, a second input terminal of the AND gate AG7 is coupled to an output of the inverter INV8, and an output terminal of the AND gate AG7 is configured for outputting the first output signal 01. A first input terminal of the AND gate AG8 is coupled to an input of the delay cell DLY6, a second input terminal of the AND gate AG8 is coupled to an output of the inverter INV7, and an output terminal of the AND gate AG8 is configured for outputting the second output signal 02.

Furthermore, the ramp generator 319 is coupled to the PWM signal generating unit 315 and the phase-splitting circuit 317, and is configured for generating the ramp signal RMP in response to the first and the second output signals 01 and 02. To be specific, the ramp generator 319 includes an NOR gate NR, an N-type transistor N5, a current source I1 and a capacitor C6. A first input terminal of the NOR gate NR is configured for receiving the first output signal 01, and a second input terminal of the NOR gate NR is configured for receiving the second output signal 02. A gate of the N-type transistor N5 is coupled to an output of the NOR gate NR, a drain of the N-type transistor N5 is configured for generating the ramp signal RMP, and a source of the N-type transistor N5 is coupled to the ground potential GND.

The current source I1 is coupled between a bias $V_{RMP}$ and the drain of the N-type transistor N5. A first terminal of the capacitor C6 is coupled to the drain of the N-type transistor N5, and a second terminal of the capacitor C6 is coupled to the ground potential GND. In this embodiment, the capacitor C6 would be charged by the current source I1 in response to the enabling of the respective first and second output signals 01 and 02, so as to determine the rising slope of the ramp signal RMP. Moreover, the capacitor C6 would be discharged in response to the dead time of the first and second output signals 01 and 02, so as to determine the descending slope of the ramp signal RMP.

Besides, the current regulation circuit 321 is coupled to the fluorescent lamp CL and the PWM signal generating unit 315, and is configured for generating the comparison voltage CMP in response to a current flowing through the fluorescent lamp CL and a predetermined reference voltage Vref3, so as to adjust the PWM signal PW outputted by the PWM signal generating unit 315, and stabilize the current flowing through the fluorescent lamp CL to a predetermined current value. Obviously, the current regulation circuit 321 can be used for precise current feedback control.

To be specific, the current regulation circuit 321 includes resistors R4 and R5, an error amplifier EA and a capacitor C7. A first terminal of the resistor R4 is coupled to one end of the fluorescent lamp CL (i.e. the low-side of the fluorescent lamp CL), and a second terminal of the resistor R4 is coupled to the ground potential GND. A first terminal of the resistor R5 is coupled to the first terminal of the resistor R4. A positive input terminal (+) of the error amplifier EA is configured for receiving the predetermined reference voltage Vref3, a negative input terminal (−) of the error amplifier EA is coupled to a second terminal of the resistor R5, and an output terminal of the error amplifier EA is configured for outputting the comparison voltage CMP. A first terminal of the capacitor C7 is coupled to the second terminal of the resistor R5, and a second terminal of the capacitor C7 is coupled to the output terminal of the error amplifier EA.

On the other hand, in this embodiment, the clamp circuit 323 is coupled to the LC resonator 203 and the current regulation circuit 321, and is configured for adjusting the comparison voltage CMP according to a voltage feedback signal VFB relating to the sinusoidal driving signal SIN generated by the LC resonator 203 and a predetermined reference voltage Vref4, so as to suppress a voltage of the sinusoidal driving signal SIN generated by the LC resonator 203 to a predetermined reference value, namely, the over-voltage protection (OVP). Obviously, the clamp circuit 323 can also prevent the sinusoidal driving signal SIN from an over voltage situation, which is generally implemented during an initial phase of the fluorescent lamp CL, but not limited thereto.

To be specific, the clamp circuit 323 includes diodes D6 and D7, a capacitor C8, a resistor R6, a comparator CP4, an N-type transistor N6 and a current source 12. An anode of the diode D6 is coupled to the second terminal of the capacitor C2 of the LC resonator 203 for receiving the voltage feedback signal VFB. An anode of the diode D7 is coupled to the ground potential GND, and a cathode of the diode D7 is coupled to the anode of the diode D6. A first terminal of the capacitor C8 is coupled to a cathode of the diode D6, and a second terminal of the capacitor C8 is coupled to the ground potential GND. The resistor R6 is coupled with the capacitor C8 in parallel. A positive input terminal (+) of the comparator CP4 is coupled to the cathode of the diode D6, a negative input terminal (−) of the comparator CP4 is configured for receiving the predetermined reference voltage Vref4. A gate of the N-type transistor N6 is coupled to an output of the comparator CP4, and a source of the N-type transistor N6 is coupled to the negative input terminal (−) of the error amplifier EA. The current source 12 is coupled between a bias Vclamp and a drain of the N-type transistor N6.

In this embodiment, when the sinusoidal driving signal SIN generated by the LC resonator 203 is excessively high, the voltage feedback signal VFB relating to the sinusoidal driving signal SIN generated by the LC resonator 203 would be greater than the predetermined reference voltage Vref4. Accordingly, the current source 12 would be conducted to the negative input terminal (−) of the error amplifier EA in response to the turned-on N-type transistor N6, so as to pull up the level of the comparison voltage CMP and thus reducing the duty cycle of the PWM signal PW generated by the PWM signal generating unit 315. Accordingly, the voltage of the sinusoidal driving signal SIN generated by the LC resonator 203 would be suppressed to a predetermined voltage value, and therefore to achieve the purpose of over-voltage protecting.

Besides, the protection circuit 325 is coupled to the phase-splitting circuit 317 and the current regulation circuit 321, and is configured for generating a disabling signal DIS to disable the phase-splitting circuit 317 in response to an open-circuit or a short-circuit of the fluorescent lamp CL, namely, the phase-splitting circuit 317 would stop generating the first and the second output signals 01 and 02. Obviously, the protection circuit 325 can activate a protection mechanism (which is generally implemented during an operation phase of the fluorescent lamp CL, but not limited thereto) when the fluorescent lamp CL is in abnormal.

To be specific, the protection circuit 325 includes diodes D8 and D9, a capacitor C9, a resistor R7 and a comparator CP5. An anode of the diode D8 is coupled to the first terminal of the resistor R4 of the current regulation circuit 321. An anode of the diode D9 is coupled to the ground potential GND, and a cathode of the diode D9 is coupled to the anode of the diode D8. A first terminal of the capacitor C9 is coupled to a cathode of the diode D8, and a second terminal of the capacitor C9 is coupled to the ground potential GND. The resistor R7 is coupled with the capacitor C7 in parallel. A positive input terminal (+) of the comparator CP5 is coupled to the cathode of the diode D8, a negative input terminal (−) of the comparator CP5 is configured for receiving the predetermined reference voltage Vref5, and an output terminal of the comparator CP5 is configured for outputting, in response to the open-circuit or the short-circuit of the fluorescent lamp CL, the disabling signal DIS.

In this embodiment, regardless of either the open-circuit of the fluorescent lamp CL or the short-circuit of the fluorescent lamp CL, due to the voltage of the node ND is smaller than the predetermined reference voltage Vref5, the comparator CP5 would output the disabling signal DIS with the logic low level (i.e. logic "0") to the third input terminals of the AND gates AG7 and AG8 both in the phase-splitting circuit 317. Accordingly, the phase-splitting circuit 317 would stop generating the first and the second output signals 01 and 02, so as to stop the generation of the sinusoidal driving signal SIN.

Figure 6A:
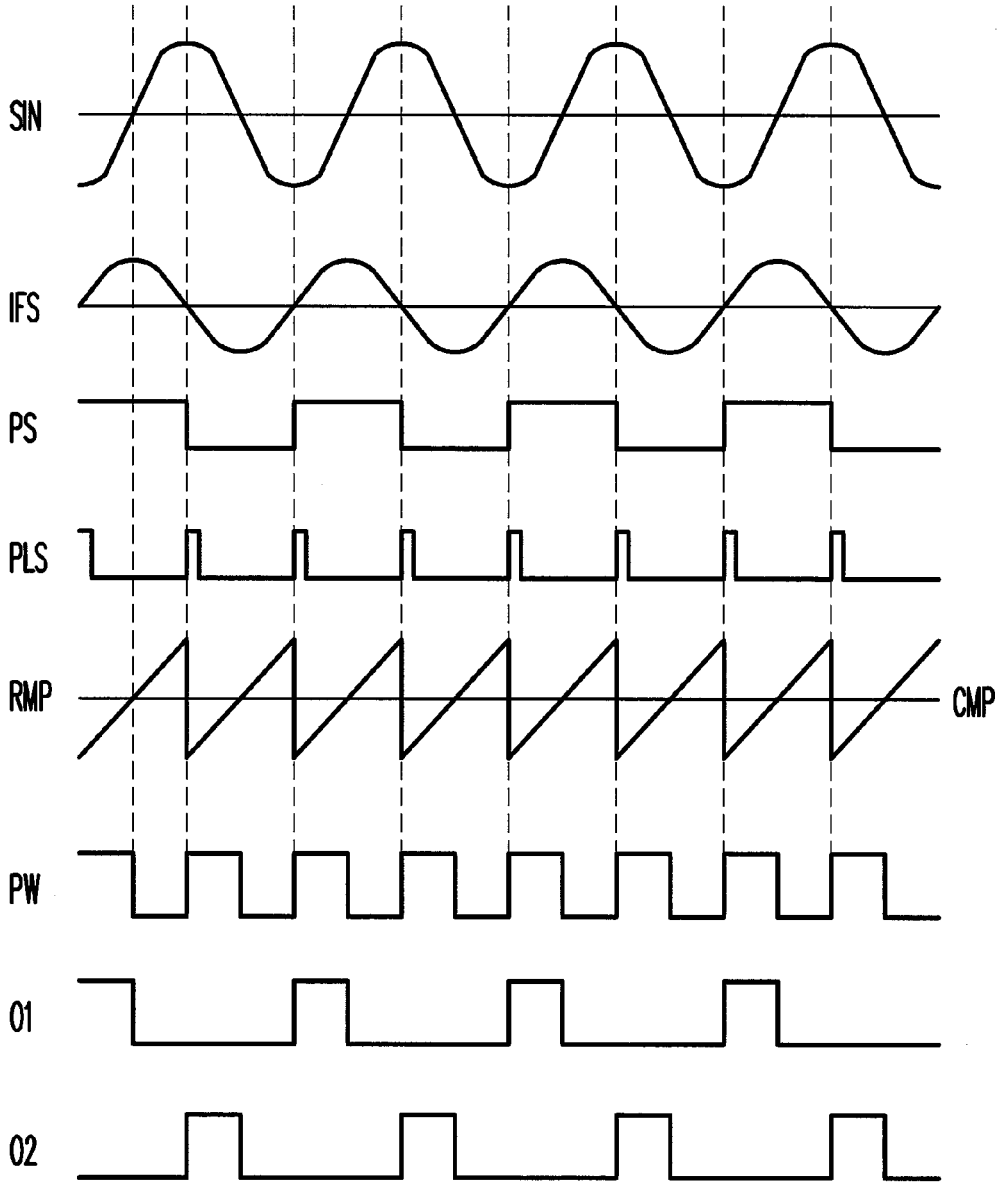
FIG. 6A is a waveform diagram of a part of signals of the driving apparatus 20 of the fluorescent lamp CL according to an embodiment of the invention.

From the above, FIG. 6A is a waveform diagram of a part of signals of the driving apparatus 20 of the fluorescent lamp CL according to an embodiment of the invention. According to FIG. 6A (also referring to FIGS. 4 and 5), in case that the current feedback signal IFS is oscillated, the phase signal generator 307 would generate the phase signal PS. Therefore, the following descriptions are deduced:

1. The phase signal detector 309 would output the enabling signal EN with the logic low level to the starting of oscillation circuit 311, so as to make that the starting of oscillation circuit 311 transmits/conducts the phase signal PS to the pulse signal generator 313 and the phase-splitting circuit 317;

2. The pulse signal generator 313 would output the pulse signal PLS in response to the phase signal PS and the delay of the delay cell DLY3;

3. The PWM signal generating unit 315 would output the PWM signal PW in response to the ramp signal RMP, the comparison voltage CMP and the pulse signal PLS;

4. The phase-splitting circuit 317 would perform phase-splitting to the PWM signal PW in response to the phase signal PS, so as to obtain the first and the second output signals 01 and 02 with a phase difference of 180 degrees;

5. The sinusoidal driving signal SIN would be generated through the power switching circuit 201 and the LC resonator 203 for driving the fluorescent lamp CL in response to the first and the second output signals 01 and 02; and 6. When the sinusoidal driving signal SIN is rising from the relative low point to the relative high point, the phase-splitting circuit 317 would generate the first output signal 01; moreover, when the sinusoidal driving signal SIN is descending from the relative high point to the relative low point, the phase-splitting circuit 317 would generate the second output signal 02.

According to the above descriptions 1-6, in case that the current feedback signal IFS is oscillated, the automatic frequency tracing circuit 205 makes the frequency of the sinusoidal driving signal SIN that is generated by the LC resonator 203 and used for driving the fluorescent lamp CL to automatically follow the resonant frequency of the LC resonator 203. In this way, as long as the quality factor (Q value) of the LC resonator 203 is designed relatively higher, a relatively large output to input ratio is obtained, and the driving apparatus 20 can successfully drive the fluorescent lamp CL without using a boost transformer.

Figure 6B:
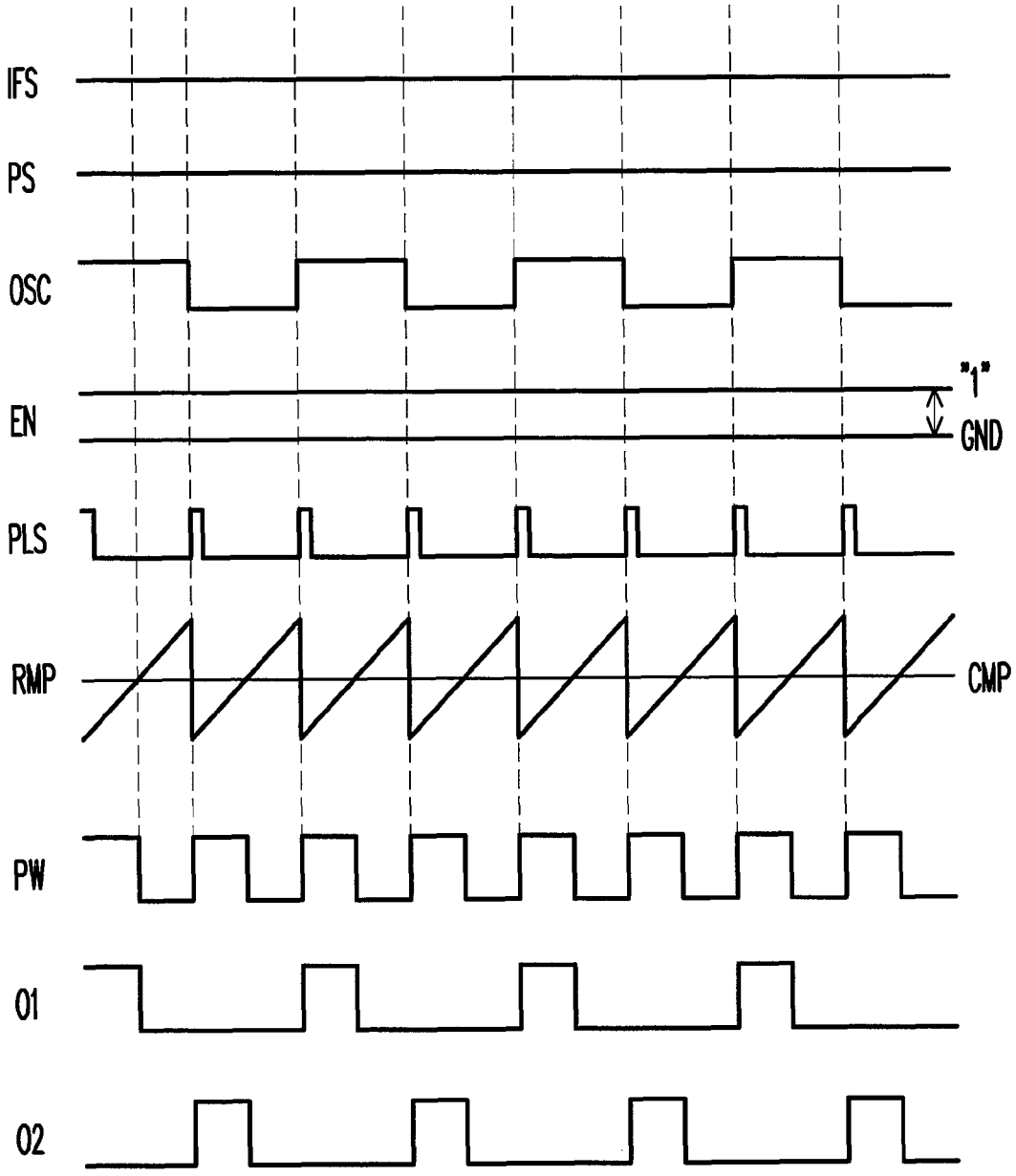
FIG. 6B is a waveform diagram of a part of signals of the driving apparatus 20 of the fluorescent lamp CL according to another embodiment of the invention.

FIG. 6B is a waveform diagram of a part of signals of the driving apparatus 20 of the fluorescent lamp CL according to another embodiment of the invention. According to FIG. 6B (also referring to FIGS. 4 and 5), in case that the current feedback signal IFS is not oscillated, the phase signal generator 307 would not generate the phase signal PS. Therefore, the following descriptions are deduced:

7. The phase signal detector 309 would output the enabling signal EN with the logic high level to the starting of oscillation circuit 311, so as to make that the starting of oscillation circuit 311 transmits/conducts the oscillation signal OSC to the pulse signal generator 313 and the phase-splitting circuit 317;

8. The pulse signal generator 313 would output the pulse signal PLS in response to the oscillation signal OSC and the delay of the delay cell DLY3;

9. The PWM signal generating unit 315 would output the PWM signal PW in response to the ramp signal RMP, the comparison voltage CMP and the pulse signal PLS;

10. The phase-splitting circuit 317 would perform phase-splitting to the PWM signal PW in response to the oscillation signal OSC, so as to obtain the first and the second output signals 01 and 02 with a phase difference of 180 degrees; and 11. The sinusoidal driving signal SIN would be generated through the power switching circuit 201 and the LC resonator 203 for driving the fluorescent lamp CL in response to the first and the second output signals 01 and 02.

Similarly, after the sinusoidal driving signal SIN is generated on the basis of the oscillation signal OSC, when the sinusoidal driving signal SIN is rising from the relative low point to the relative high point, the phase-splitting circuit 317 would generate the first output signal 01; moreover, when the sinusoidal driving signal SIN is descending from the relative high point to the relative low point, the phase-splitting circuit 317 would generate the second output signal 02.

According to the above descriptions 7-11, in case that the current feedback signal IFS is not oscillated, the automatic frequency tracing circuit 205 still makes the frequency of the sinusoidal driving signal SIN that is generated by the LC resonator 203 and used for driving the fluorescent lamp CL to automatically follow the resonant frequency of the LC resonator 203. In this way, as long as the quality factor (Q value) of the LC resonator 203 is designed relatively higher, the driving apparatus 20 also can successfully drive the fluorescent lamp CL without using a boost transformer.

Figure 6C:
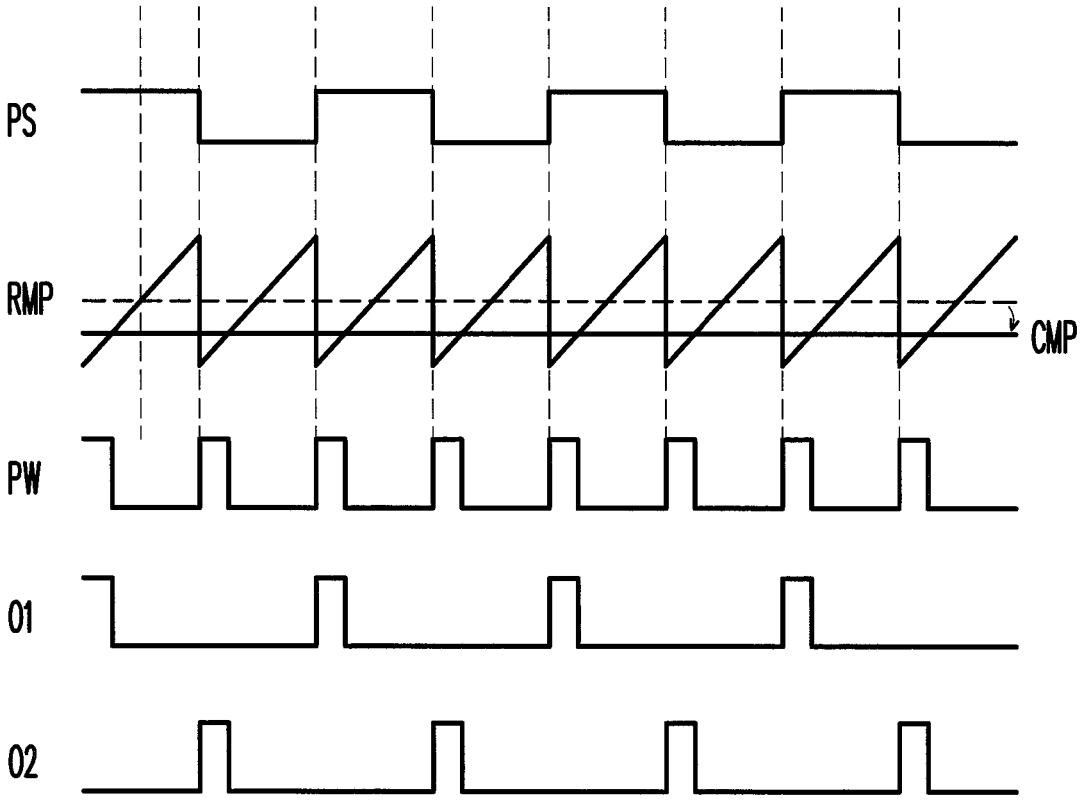
FIG. 6C is a waveform diagram of a part of signals of the driving apparatus 20 of the fluorescent lamp CL according to still another embodiment of the invention.

FIG. 6C is a waveform diagram of a part of signals of the driving apparatus 20 of the fluorescent lamp CL according to still another embodiment of the invention. According to FIG. 6A (also referring to FIGS. 4 and 5), in case that the voltage of the sinusoidal driving signal SIN is excessively high, for example, during an initial phase of the fluorescent lamp CL. Therefore, the following descriptions are deduced:

12. Due to the voltage feedback voltage VFB is greater than the predetermined reference voltage Vref4, the clamp circuit would pull down the comparison voltage CMP provided by the current regulation circuit 321, and thus reducing the duty cycle of the PWM signal PW generated by the PWM signal generating unit 315;

13. The phase-splitting circuit 317 would perform the phase-splitting to the PWM signal PW which duty cycle is reduced in response to the phase signal PS, so as to obtain the two output signals 01 and 02 with less energies and a phase difference of 180 degrees (it is obvious compared to that of FIG. 6A and FIG. 6B).

According to the above descriptions 12 and 13, the clamp circuit 323 can suppress the voltage of the sinusoidal driving signal SIN to a predetermined voltage value during an initial phase of the fluorescent lamp CL, such that the over voltage protection (OVP) for preventing the fluorescent lamp CL from damaging can be achieved. On the other hand, when the fluorescent lamp CL is in abnormal, for example, open-circuit or short-circuit, the protection circuit 325 would output the disabling signal DIS with the logic low level to disable the phase-splitting circuit 317 due to the voltage of the node ND is greater than the predetermined reference voltage Vref5, such that the generation of the sinusoidal driving signal SIN would be stopped for preventing the unnecessary power loss.

In summary, in the invention, the automatic frequency tracing circuit 205 is used to trace the resonant frequency of the LC resonator 203, so that regardless of how the resonant frequency of the LC resonator 203 varies, the automatic frequency tracing circuit 205 makes the frequency of the sinusoidal driving signal that is generated by the LC resonator 203 and used for driving the fluorescent lamp CL to automatically follow the resonant frequency of the LC resonator 203. In this way, as long as the quality factor (Q value) of the LC resonator is designed relatively higher, a relatively large output to input ratio is obtained, so that the fluorescent lamp CL can be successfully driven without using a boost transformer.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for driving a fluorescent lamp, comprising:

a power switching circuit, coupled between an input voltage and a ground potential, configured for switching and outputting the input voltage and the ground potential in response to two output signals with a phase difference of 180 degrees, so as to generate a square signal;

an LC resonator, coupled to the power switching circuit, configured for receiving and converting the square signal, so as to generate a sinusoidal driving signal for driving the fluorescent lamp; and an automatic frequency tracing circuit, coupled to the power switching circuit and the LC resonator, configured for generating and adjusting the output signals according to a current feedback signal relating to the sinusoidal driving signal, so as to make a frequency of the sinusoidal driving signal automatically follow a resonant frequency of the LC resonator.

2. The apparatus according to claim 1, wherein the output signals comprise a first output signal and a second output signal, and the power switching circuit comprises:

a high-side buffer, configured for receiving and buffering-outputting the first output signal;

a low-side buffer, configured for receiving and buffering-outputting the second output signal; and a switching circuit, coupled between the input voltage and the ground potential and coupled to the high-side buffer and the low-side buffer, configured for switching and outputting the input voltage and the ground potential in response to the buffered-outputted first and second output signals, so as to generate the square signal.

3. The apparatus according to claim 2, wherein the switching circuit comprises:

a first N-type power transistor, having a drain coupled to the input voltage, a source generating the square signal, and a gate receiving the buffered-outputted first output signal; and a second N-type power transistor, having a source coupled to the ground potential, a drain coupled to the source of the first N-type power transistor, and a gate receiving the buffered-outputted second output signal.

4. The apparatus according to claim 3, wherein the high-side buffer comprises:

a level shifter, configured for receiving the first output signal, and pulling up a level of the first output signal in response to a rising edge and a falling edge of the first output signal; and a high-side driver, coupled to the level shifter, configured for generating the buffered-outputted first output signal in response to an output of the level shifter.

5. The apparatus according to claim 4, wherein the level shifter comprises:

a first delay cell, configured for receiving and delaying-outputting the first output signal;

a first inverter, having an input terminal coupled to an output of the first delay cell;

a first AND gate, having a first input terminal coupled to an output of the first inverter and a second input terminal coupled to an input of the first delay cell;

a second inverter, having an input terminal coupled to the input of the first delay cell;

a second delay cell, configured for receiving and delaying-outputting an output of the second inverter;

a third inverter, having an input terminal coupled to an output of the second delay cell;

a second AND gate, having a first input terminal coupled to an output of the third inverter and a second input terminal coupled to an input of the second delay cell;

a first N-type transistor, having a gate coupled to an output of the first AND gate and a source coupled to the ground potential;

a second N-type transistor, having a gate coupled to an output of the second AND gate and a source coupled to the ground potential;

a first resistor, having a first terminal coupled to a drain of the first N-type transistor;

a second resistor, having a first terminal coupled to a drain of the second N-type transistor and a second terminal coupled to a second terminal of the first resistor; and an $\overline{SR}$ flip-flop, having a set terminal coupled to the first terminal of the first resistor, a reset terminal coupled to the first terminal of the second resistor and an output terminal outputting the pulled up first output signal.

6. The apparatus according to claim 5, wherein the high-side driver comprises:

a P-type transistor, having a gate coupled to the output terminal of the $\overline{SR}$ flip-flop, a source coupled to the second terminals of the first and the second resistors and a drain coupled to the gate of the first N-type power transistor;

a third N-type transistor, having a gate coupled to the gate of the P-type transistor, a drain coupled to the drain of the P-type transistor and a source coupled to the source of the first N-type power transistor;

a diode, having an anode receiving a system voltage and a cathode coupled to the source of the P-type transistor; and a capacitor, having a first terminal coupled to the cathode of the diode and a second terminal coupled to the source of the first N-type power transistor.

7. The apparatus according to claim 3, wherein the low-side buffer comprises:

a low-side driver, configured for generating the buffered-outputted second output signal in response to the second output signal.

8. The apparatus according to claim 7, wherein the low-side driver comprises:

a P-type transistor, having a gate receiving the second output signal, a source receiving a system voltage and a drain coupled to the gate of the second N-type power transistor; and an N-type transistor, having a gate coupled to the gate of the P-type transistor, a drain coupled to the drain of the P-type transistor and a source coupled to the ground potential.

9. The apparatus according to claim 1, wherein the LC resonator comprises:

a first capacitor, having a first terminal receiving the square signal;

an inductor, having a first terminal coupled to a second terminal of the first capacitor and a second terminal generating the sinusoidal driving signal;

a second capacitor, having a first terminal coupled to the second terminal of the inductor; and a third capacitor, having a first terminal coupled to a second terminal of the second capacitor and a second terminal generating the current feedback signal.

10. The apparatus according to claim 9, wherein the automatic frequency tracing circuit comprises:

a phase signal generator, configured for outputting a phase signal in response to the current feedback signal;

a pulse signal generator, coupled to the phase signal generator, configured for generating a pulse signal in response to the phase signal;

a pulse width modulation (PWM) signal generating unit, coupled to the pulse signal generator, configured for generating a PWM signal in response to a ramp signal, a comparison voltage and the pulse signal;

a phase-splitting circuit, coupled to the PWM signal generating unit, configured for receiving the PWM signal, and performing phase-splitting to the PWM signal in response to the phase signal, so as to obtain the output signals; and a ramp generator, coupled to the PWM signal generating unit and the phase-splitting circuit, configured for generating the ramp signal in response to the output signals.

11. The apparatus according to claim 10, wherein the phase signal generator comprises:

a first comparator, having a positive input terminal receiving the current feedback signal, a negative input terminal receiving a first predetermined reference voltage and an output terminal outputting the phase signal;

a first diode, having an anode coupled to the positive input terminal of the first comparator and a cathode coupled to the ground potential; and a second diode, having a cathode coupled to the positive input terminal of the first comparator and an anode coupled to the ground potential.

12. The apparatus according to claim 11, wherein the pulse signal generator comprises:

a first delay cell, configured for receiving and delaying-outputting the phase signal;

an NXOR gate, having a first input terminal receiving the phase signal and a second input terminal receiving an output of the first delay cell; and a first inverter, having an input terminal coupled to an output of the NXOR gate and an output terminal outputting the pulse signal.

13. The apparatus according to claim 12, wherein the PWM signal generating unit comprises:

a second comparator, having a positive input terminal receiving the ramp signal, a negative input terminal receiving the comparison voltage and an output terminal outputting a comparison signal; and an SR flip-flop, having a set terminal receiving the pulse signal, a reset terminal receiving the comparison signal and an output terminal outputting the PWM signal.

14. The apparatus according to claim 13, wherein the output signals comprise a first output signal and a second output signal, and the phase-splitting circuit comprises:

a second delay cell, configured for receiving and delaying-outputting the PWM signal;

a first AND gate, having a first input terminal receiving the phase signal and a second input terminal coupled to an output of the second delay cell;

a second inverter, having an input terminal receiving the phase signal;

a second AND gate, having a first input terminal coupled to an output of the second inverter and a second input terminal coupled to the output of the second delay cell;

a third delay cell, configured for receiving and delaying-outputting an output of the first AND gate;

a fourth delay cell, configured for receiving and delaying-outputting an output of the second AND gate;

a third inverter, having an input terminal coupled to an output of the third delay cell;

a fourth inverter, having an input terminal coupled to an output of the fourth delay cell;

a third AND gate, having a first input terminal coupled to an input of the third delay cell, a second input terminal coupled to an output of the fourth inverter and an output terminal outputting the first output signal; and a fourth AND gate, having a first input terminal coupled to an input of the fourth delay cell, a second input terminal coupled to an output of the third inverter and an output terminal outputting the second output signal.

15. The apparatus according to claim 14, wherein the ramp generator comprises:

an NOR gate, having a first input terminal receiving the first output signal and a second input terminal receiving the second output signal;

an N-type transistor, having a gate coupled to an output of the NOR gate, a drain generating the ramp signal and a source coupled to the ground potential;

a current source, coupled between a bias and the drain of the N-type transistor; and a fourth capacitor, having a first terminal coupled to the drain of the N-type transistor and a second terminal coupled to the ground potential.

16. The apparatus according to claim 10, wherein the automatic frequency tracing circuit further comprises:

a starting of oscillation circuit, coupled to the phase signal generator, the pulse signal generator and the phase-splitting circuit, configured for transmitting, when the phase signal is oscillated, the phase signal to the pulse signal generator in response to an enabling signal, so as to make the pulse signal generator generate the pulse signal, wherein the starting of oscillation circuit is further configured for providing, when the phase signal is not oscillated, an oscillation signal to the pulse signal generator in response to the enabling signal, so as to make the pulse signal generator generate the pulse signal until the phase signal is oscillated.

17. The apparatus according to claim 16, wherein the automatic frequency tracing circuit further comprises:

a phase signal detector, coupled to the phase signal generator and the starting of oscillation circuit, configured for receiving and detecting whether the phase signal is oscillated or not, and generating the enabling signal to the starting of oscillation circuit accordingly.

18. The apparatus according to claim 17, wherein the starting of oscillation circuit comprises:

an oscillator, configured for generating the oscillation signal;

a first AND gate, having a first input terminal receiving the oscillation signal and a second input terminal receiving the enabling signal;

an inverter, having an input terminal receiving the enabling signal;

a second AND gate, having a first input terminal receiving the phase signal and a second input terminal coupled to an output of the inverter; and an OR gate, having a first input terminal coupled to an output of the first AND gate, a second input terminal coupled to an output of the second AND gate and an output terminal outputting, in response to the enabling signal, the phase signal or the oscillation signal.

19. The apparatus according to claim 18, wherein the phase signal detector comprises:

a first diode, having an anode receiving the phase signal;

a second diode, having an anode coupled to the ground potential and a cathode coupled to the anode of the first diode;

a fourth capacitor, having a first terminal coupled to a cathode of the first diode and a second terminal coupled to the ground potential;

a resistor, coupled with the fourth capacitor in parallel; and a comparator, having a positive input terminal receiving a predetermined reference voltage, a negative input terminal coupled to the cathode of the first diode and an output terminal outputting the enabling signal.

20. The apparatus according to claim 10, wherein the automatic frequency tracing circuit further comprises:

a current regulation circuit, coupled to the fluorescent lamp and the PWM signal generating unit, configured for generating the comparison voltage in response to a current flowing through the fluorescent lamp and a first predetermined reference voltage, so as to adjust the PWM signal outputted by the PWM signal generating unit, and stabilize the current flowing through the fluorescent lamp to a predetermined current value.

21. The apparatus according to claim 20, wherein the current regulation circuit comprises:

a first resistor, having a first terminal coupled to one end of the fluorescent lamp and a second terminal coupled to the ground potential;

a second resistor, having a first terminal coupled to the first terminal of the first resistor;

an error amplifier, having a positive input terminal receiving the first predetermined reference voltage, a negative input terminal coupled to a second terminal of the second resistor and an output terminal outputting the comparison voltage; and a fourth capacitor, having a first terminal coupled to the second terminal of the second resistor and a second terminal coupled to the output terminal of the error amplifier.

22. The apparatus according to claim 21, wherein the automatic frequency tracing circuit further comprises:

a clamp circuit, coupled to the LC resonator and the current regulation circuit, configured for adjusting the comparison voltage according to a voltage feedback signal relating to the sinusoidal driving signal and a second predetermined reference voltage, so as to suppress a voltage of the sinusoidal driving signal to a predetermined reference value.

23. The apparatus according to claim 21, wherein the clamp circuit comprises:

a first diode, having an anode coupled to the second terminal of the second capacitor for receiving the voltage feedback signal;

a second diode, having an anode coupled to the ground potential and a cathode coupled to the anode of the first diode;

a fifth capacitor, having a first terminal coupled to a cathode of the first diode and a second terminal coupled to the ground potential;

a third resistor, coupled with the fifth capacitor in parallel;

a comparator, having a positive input terminal coupled to the cathode of the first diode, a negative input terminal receiving the second predetermined reference voltage;

an N-type transistor, having a gate coupled to an output of the comparator and a source coupled to the negative input terminal of the error amplifier; and a current source, coupled between a bias and a drain of the N-type transistor.

24. The apparatus according to claim 21, wherein the automatic frequency tracing circuit further comprises:

a protection circuit, coupled to the phase-splitting circuit and the current regulation circuit, configured for generating a disabling signal to disable the phase-splitting circuit in response to an open-circuit or a short-circuit of the fluorescent lamp.

25. The apparatus according to claim 24, wherein the protection circuit comprises:

a first diode, having an anode coupled to the first terminal of the first resistor;

a second diode, having an anode coupled to the ground potential and a cathode coupled to the anode of the first diode;

a fifth capacitor, having a first terminal coupled to a cathode of the first diode and a second terminal coupled to the ground potential;

a third resistor, coupled with the fifth capacitor in parallel; and a comparator, having a positive input terminal coupled to the cathode of the first diode, a negative input terminal receiving the second predetermined reference voltage and an output terminal outputting, in response to the open-circuit or the short-circuit of the fluorescent lamp, the disabling signal.

* * * * *